US005158576A

United States Patent [19]

Brodmann

[11] Patent Number: 5,158,576

[45] **Date of Patent: * Oct. 27, 1992**

[54] PROCESS OF DYEING SYNTHETIC FABRICS USING HIGH-BOILING ESTER SOLVENTS

[75] Inventor: George Brodmann, Greensboro, N.C.

[73] Assignee: Burlington Industries Inc., Greensboro, N.C.

[ * ] Notice: The portion of the term of this patent subsequent to Feb. 22, 2007 has been disclaimed.

[21] Appl. No.: 412,101

[22] Filed: Sep. 25, 1989

Related U.S. Application Data

[62] Division of Ser. No. 45,557, May 4, 1987, Pat. No. 4,927,429.

[51] Int. Cl.[5] ..... D06P 1/46

[52] U.S. Cl. ..... 8/938; 8/583

[58] Field of Search ..... 8/938, 583

[56] References Cited

U.S. PATENT DOCUMENTS 4,529,405 7/1985 Wilson ..... 8/583

4,927,429 5/1990 Brodmann ..... 8/583

OTHER PUBLICATIONS

Trotman, *Dyeing and Chemical Technology of Textile Fibers*, pp. 440–441 (1984).

*Primary Examiner*—John Niebling

*Assistant Examiner*—Kathryn Gorgos

*Attorney, Agent, or Firm*—Nixon & Vanderhye

[57] ABSTRACT

Synthetic textile fibers are dyed in a waterless coloring composition composed of a high-boiling ester solvent and a dye that (a) is soluble to the extent of at least 1.5% in the solvent, (b) provides a depth of coloration, expressed as yield, of at least 25%, (c) imparts to the dyed fibers a lightfastness value of at least 3, and (d) provides the dyed fibers with a washfastness value of at least 3.

8 Claims, No Drawings

PROCESS OF DYEING SYNTHETIC FABRICS USING HIGH-BOILING ESTER SOLVENTS

This is a division of application Ser. No. 07/045,557, filed May 4, 1987, now U.S. Pat. No. 4,927,429, issued May 11, 1992.

BACKGROUND OF THE INVENTION

This invention relates to a process for dyeing synthetic fabrics using high-boiling ester solvent media in which a dye or mixture of dyes meeting selected performance and physical criteria is used.

Synthetic fabrics can be dyed rapidly and effectively at elevated temperatures using dyes dissolved in and applied from high-boiling ester-type solvents. Waterless dye compositions for apparel and other thermoplastic articles are described in a series of U.S. patents to Robert B. Wilson, more fully identified below, and exemplified by U.S. Pat. No. 4,581,035. See also U.S. Pat. No. 4,550,579 to Clifford which proposes using the same ester materials in a non-reactive, inert atmosphere.

The Wilson-type waterless dyeing compositions are said to include the use of various dyes or pigments as organic colorants in these waterless dye compositions. A wide variety of candidate dyes and pigments are identified in column 8 of this patent, as well as in column 13, lines 31–35 of the Clifford patent. These documents indicate that the choices of suitable dyes and pigments are extremely wide, and that results using any particular dye or pigment selected are comparable, one to the other. It has now been found that only a limited number of dyes meeting very stringent and diverse criteria are actually suitable and form a preferred class for dyeing synthetic fibers, notably nylons and polyesters.

The process of the present invention in one aspect features the use of solvent dyes dissolved in high-boiling ester solvents to color synthetic textiles, notably polyester and nylon. Relatively few dyes are soluble in these high-boiling organic ester materials. The common practice in the art has been to use a class of water-insoluble dyes known as disperse dyes, that is, dyes that are only dispersible rather than soluble in water. These dyes are the type exemplified in the Wilson patent noted above.

SUMMARY OF THE INVENTION

Described is a process for dyeing synthetic textile fibers by dyeing them at elevated temperatures in a waterless coloring composition composed of a high-boiling ester solvent and a specifically selected dye. The dye or mixture of dyes used must meet the following criteria: (1) The dye must be soluble in the high-boiling solvent at 350° F. to the extent of at least 1.5% by weight based on the weight of the solvent, (2) the dye must provide a yield, calculated as the quotient of the integrated depth value of a sample dyed in the ester solvent divided by the integrated depth value of a sample dyed in an aqueous dyeing system with the same weight of a proven disperse dye of the same or substantially the same color, expressed as % yield, of at least 25%, (3) the dye must exhibit on a fabric a lightfastness value, according to AATCC Test Method 16A-1982 for 40 hours of exposure, of at least 3, and (4) the dye must provide a washfastness value of at least 3 according to AATCC Test Method 61-1985-IA.

Other features of the invention will be apparent from the detailed description that follows.

DETAILED DESCRIPTION OF THE INVENTION

Before discussing details of the process of this invention, it is important to carefully define the terms as used in the following disclosure, specification and claims, and as generally used in the dyeing art in which perhaps the preeminent text is The Colour Index. The Colour Index refers to dye classes, such as acid dyes, basic dyes, disperse dyes, solvent dyes, etc., as usage classes. Specific usage names such as C.I. Solvent Yellow 77 are formally called C.I. Generic Names; less formally, use or usage names. The "generic" derives from the multiple manufacturers' specific tradenames for the same dye. The 5-digit number accompanying the dye when its structure is known—C.I. 11855 for the above yellow dye—is its "C.I. Constitution Number".

There are distinct differences between disperse dyes and the solvent dyes used in the process of this invention. The terms "disperse dye" and "solvent dye" are "use" terms, and both of them encompass dyes containing very similar chemical groupings. The chemistry of the dyes, therefore, offers no general promise for distinguishing between the two use classes.

Historically, the name "disperse dyes" reflects the fact that they are mostly used as slightly soluble dispersions in aqueous media. A "solvent dye", on the other hand, is intended for use in a non-aqueous organic solvent. In the context of the present invention, the general difference between disperse dyes and solvent dyes is that in the dyeings in high-boiling hydrophobic solvents, the solvent dyes are more soluble, resulting in greater color yields in many but not all instances, a greater margin of protection against a need for excessive heating to put them in solution, and more capacity for avoiding dye precipitation if the dye solution inadvertently cools while being used. All of these are significant engineering advantages.

Disperse dyes are not sold simply as the powder or solid themselves; rather, they are formulated and designed for use in an aqueous medium. A commercial disperse dyestuff, designed for use in an aqueous medium, is made by washing the solid presscake from the dye synthesis thoroughly with water and then, since the dye itself is virtually insoluble in water, mixing it with a sizable amount of dispersing agent and other additives, if desired. The exact amount of dispersant and additives is varied, depending on the analysis of colorant in each batch, as the way of assuring equal amounts of dye, and thereby color uniformity, from lot to lot. The presscake, whether wet or dried, is known loosely in the art as the "crude" dye; it does not really become a disperse dyestuff until it is mixed with dispersant. This dispersant typically constitutes 60–80% of the weight of commercial disperse dyestuffs, and is anionic in nature.

To determine potentially suitable dyes from the large number of candidates available, a simple solubility screening test was conducted. In this test, an excess weight of the candidate dye was slurried in tris(2-ethylhexyl) trimellitate at 350° F., the mixture filtered rapidly, the weight of the dye caught on the filter recorded, and the percentage of dye dissolved in the hot solvent, based on the weight of the solvent, calculated. Further details of this test are given below. A minimum solubility value of 1.5% is required to pass this initial test.

Given their high content of anionic water soluble dispersants, commercial disperse dyes cannot be more than fractionally soluble in hydrophobic solvents such as tris(2-ethylhexyl) trimellitate. Unlike their good dispersions in aqueous media, the commercial disperse dyes tend to produce tarry, gummy precipitates in many organic solvents.

There are two essential aspects of the invention, both dealing with the use class of the dyes employed, and more specifically with subdivisions of the solvent dye class. One is the use of nonionic solvent dyes, and the other the use of premetallized solvent dyes.

The high-boiling ester solvent used in the process of this invention is an organic composition that remains stable within the temperature range of from about 50° F. to about 450° F. Such high-boiling organic solvents are described in the patent literature and elsewhere as vehicles or solvents for dyestuffs and pigments to form waterless dyeing compositions. See, for example, U.S. Pat. No. 4,293,305 to Wilson.

The aromatic esters can be of the formula $ArCOOR_2$, $ArCOO\text{-}R_1\text{-}OOCAr$ or $(ArCOO)_2—R_3$, wherein $R_1$ is alkylene of 2–8 carbon atoms or polyoxyalkylene of the formula $(—C_rH_{2r})_s—$, in which r is 2 or 3 and s is up to 15; $R_2$ is substituted or unsubstituted alkyl or alkenyl of 8–30 atoms; $R_3$ is the residue of a polyhydric alcohol having z hydroxyl groups; Ar is mono- or bicyclic aryl of up to 15 carbon atoms and z is 3–6.

Furthermore, the cycloaliphatic ester can be of the formula:

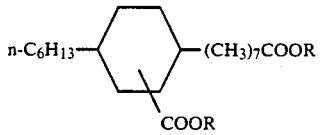

wherein R is substituted or unsubstituted straight or branched chain alkyl of 4–20 carbon atoms, polyoxyalkylene of the formula $R'(OC_xH_{2x})_n$ or phosphated polyoxyalkylene of the formula:

$$(HO)_2P(=O)(OC_xH_{2xn}OC_xOC_xH_{2x})$$

or a salt thereof, wherein $(OC_xH_{2x}O)_n$ is $C_2H_4O)_n—$,$(C_3H_6O)_n—$or $(C_2H_4O)_p$, or $(C_3H_6O)_q—$; $R^1$ is H or ArCO; Ar is mono- or bicyclic aryl of up to 15 carbon atoms; x is 2 or 3; n is 2–22 and the sum of p+q is n.

The preferred high-boiling organic solvents include triesters of 1,2,4-benzenetricarboxylic acid, also known as trimellitic acid. Preferred esters are tris(2-ethylhexyl) trimellitate, triisodecyl trimellitate, triisooctyl trimellitate, tridecyl trimellitate, and trihexadecyl trimellitate. It will be understood that mixed esters such as hexyl, octyl, decyl trimellitate can also be used. Most preferred is tris(2-ethylhexyl) trimellitate (CAS No. 3319-31-1), also known as trioctyl trimellitate, which can be purchased from Eastman Chemical Products, Inc., Kingsport, Tenn., as Kodaflex ® TOTM.

Other high-boiling, nonionic ester solvents suitable for this invention include, among others, those described in U.S. Pat. Nos. 4,293,305; 4,394,126; 4,426,297; 4,581,035; 4,602,916; 4,608,056; and 4,609,375. The preparation of the materials described above is given in U.S. Pat. No. 4,529,405, the disclosure of which is herein incorporated by reference.

TESTS FOR DETERMINING SUCCESSFUL DYES OF THE INVENTION

With both the premetallized and nonionic solvent dyes, the determination of success, hence suitability for the process of this invention, versus failure has been based on four measured and apparently distinctive parameters. These are solubility, yield, lightfastness, and wetfastness. Each feature is explained and quantified in detail below. A major difference between the process of this invention and the teaching of the prior art is that the former clearly recognizes the selectivity of a very limited number of solvent dyes particularly suited for dyeing nylon and polyester; while the latter, in the apparent absence of measurements of any of the four parameters above, suggests that virtually any dye would be successful. The four parameters selected distinguish the carefully selected dyes used in the process of this invention from the dyes generally suggested for use in high-boiling solvents. The parameters selected are consistent with the practical aspects of the art of dyeing. As a practical matter, it makes a great deal of difference whether a coloration represents only the staining of a given fiber rather than a dyeing controllable in depth of color depending on dye concentration, dyeing time, and temperature. Applicant has determined that only a small fraction of even the solvent dyes tested succeed in passing the enumerated tests, which is to say that they show promise of practical utility when employed in high-temperature dyeings in the high-boiling ester media.

Dyes suitable for use in the process of this invention are selected from the wide variety of candidate dyes available based upon a combination of four parameters: solubility of the dye in the solvent medium (for test purposes solubility was assessed in tris(2-ethylhexyl) trimellitate at 350° F.), dyeing yield, lightfastness, and washfastness.

These physical parameters are defined in detail as follows:

Solubility—The solubility of solvent dyes by weight in tris(2-ethylhexyl) trimellitate at 350° F. was determined by slurrying an excess weight T in grams of each dye in 250 g of the hot solvent, filtering the mixture rapidly through a fiberglass filter, and recording the dye caught on the filter. To facilitate testing procedures, in view of the large number of dyes tested, a tare correction was made to allow for solvent retained on the wet dye and to give the dry insolubles weight F. The percentage solubility, based on the solvent weight, was calculated for each dye using the formula:

$$\%\ \text{solubility} = \frac{(T - F)}{250} \times 100$$

The solubilities of the nonionic solvent dyes ranged from 2.0 to 4.0 percent; the premetallized solvent dyes that were soluble enough to perform in the process of the invention, from 1.5 to 3.0 percent. Both effective and ineffective dyes of both types fell within these ranges, so that determining only the solubilities of the dyes does not, by itself, form a reliable basis for separating the suitable from the unsuitable dyes.

The lower limit of solubility for dyes suited for use in the process of this invention has been set at 1.5% in tris(2-ethylhexyl) trimellitate on the basis that a lower solubility at dyeing temperature would itself lower the color and the dyeing rate too far to yield practical dyeings.

Yield—The yield, an expression of comparative depth of coloration as defined in the invention is a relative and practical value. It represents a comparison of what can be done in solvent dyeings of the invention with what can be achieved with conventional aqueous dyeings of the same substrate fabric. The basic idea behind this parameter is the practical fact that there is no incentive to resort to the generally more costly solvent dyeing if the depth of coloration it gives is so much less than what can be achieved with less costly aqueous dyeing as to offset the advantages of speed and other merits of the solvent dyeings achieved by the process of this invention.

The percentage color yield for each solvent dye is sometimes expressed in terms of the calculated KSSUM values for the solvent dyeings and the corresponding aqueous disperse dyeings; or $$\% \text{ yield} = \frac{KSSUM \text{ of solvent dyeing}}{KSSUM \text{ of disperse dyeing}} \times 100$$

The term "KSSUM" is also known as the integrated depth value as described by Besnoy, Textile Chemist and Colorist, Vol. 14, No. 5, page 34 (1982), a term which applicants have adopted for their purposes in the present invention. See also the article by Kuehni (Textile Chemist and Colorist, Vol. 10, NO. 4, page 25 (1978).

As used herein, the percent yield is expressed as:

$$\% \text{ yield} = \frac{\text{integrated depth value of solvent dyeing}}{\text{integrated depth value of disperse dyeing}} \times 100$$

Lightfastness—The lightfastness values cited for the solvent dyes of the invention were determined by AATCC Test Method 16A-1982, "Colorfastness to Light: Carbon-Arc Lamp, Continuous Light". The exposure times were 40 hours and 200 hours.

For evaluation of the results the extent of fading of each test specimen was judged by visual comparison with the Gray Scale, in which a 5 rating means no fading, as described in the AATCC Technical Manual/1986 AATCC Evaluation Procedure 1, "Gray Scale for Color Change". In order to meet minimum acceptance standards, a minimum Gray Scale acceptance rating of 3 after 40 hours has been set for the dyes suited for use in the process of this invention, but it will be noted that nearly all of the preferred premetallized dyes of the invention significantly exceeded this minimum rating even after 200 hours.

Washfastness—The washfastness values cited for the solvent dyes used in the process of the invention were determined by AATCC Test Method 61-1985-IA, "Colorfastness to Washing, Domestic; and Laundering, Commercial: Accelerated". The color loss in these 45-minute tests is designed to equal that resulting from five average hand, commercial, or home launderings. Here too the Gray Scale changes, above, are the basis for the cited ratings. The minimum acceptance rating for this test was set at 3–4.

Of these four parameters, lightfastness and washfastness are among the quality measurements of dyeing. Proper dye solubility determines whether enough dye will be present in solution around the fiber to provide for rapid diffusion into it, yet not be so soluble as to keep the dye in solution. Yield is a measure of which dyes diffuse into which fibers, and how much. The premetallized solvent dyes worked only on nylon, not polyester, for example.

Table 1 shows that out of the 65 nonionic solvent dyes tested, only four of known formula (having a C.I. Constitution Number) passed the above tests, with either nylon 66 or polyester, but only in one instance with both fibers. In addition to these chemically identifiable nonionic solvent dyes, seven more, having no C.I. Constitution Number, passed the tests of the invention: C.I. Solvent Yellow 93; C.I. Solvent Yellow 114; C.I. Solvent Orange 47; C.I. solvent Orange 60; C.I. Solvent Red 194; C.I. Solvent Violet 31; and C.I. Solvent Blue 59. Once again only one of these seven, C.I. Solvent Yellow 93, was successful with both nylon and polyester.

TABLE 1

Dyeings of Nylon and Polyethylene Terephthalate With Nonionic Solvent Dyes

| C.I. Identity | | | | | AATCC Lightfastness Rating | | AATCC Washfastness Rating |
|---|---|---|---|---|---|---|---|
| Use Name | Constitution No. | Fabric | Solubility | Yield | 40 hrs. | 200 hrs. | |
| Solvent Yellow 77 | 11855 | nylon | 3.5 | 65 | 4 | 2 | 5 |
| Solvent Red 52 | 68210 | PET | 4 | 100 | 4 | 1 | 4–5 |
| | | nylon | 4 | 80 | 3–4 | 1 | 4–5 |
| Solvent Red 111 | 60505 | PET | 3.5 | 60 | 3–4 | 1 | 4–5 |
| Solvent Violet 13 | 60725 | PET | 3 | 80 | 4 | 1 | 4–5 |
| Solvent Yellow 93 | | PET | 4 | 100 | 5 | 2 | 5 |
| | | nylon | 4 | 90 | 4–5 | 1 | 4–5 |
| Solvent Yellow 114 | | PET | 4 | 100 | 5 | 2 | 4–5 |
| Solvent Orange 47 | | nylon | 4 | 100 | 5 | 1 | 5 |
| Solvent Orange 60 | | PET | 3.5 | 100 | 4 | 1 | 4–5 |
| Solvent Red 194 | | PET | 2 | 80 | 4–5 | 1 | 5 |
| Solvent Violet 31 | | PET | 2.5 | 80 | 4 | 1 | 5 |
| Solvent Blue 59 | | nylon | 2.8 | 80 | 5 | 1 | 4–5 |

TABLE 2

Dyeings of Nylon With Premetallized Solvent Dyes

| C.I. Identity | | Solubility | Yield | AATCC Lightfastness Rating | | AATCC Washfastness Rating |
|---|---|---|---|---|---|---|
| Use Name | Constitution No. | % | % | 40 Hrs. | 200 Hrs. | |
| Solvent Yellow 21 | 18690 | 1.9 | 50 | 5 | 4–5 | 4 |
| Solvent Orange 45 | 11700 | 2.1 | 80 | 5 | 5 | 3–4 |
| Solvent Red 8 | 12715 | 1.75 | 55 | 5 | 3 | 3–4 |
| Solvent Red 102 | 15675 | 1.5 | 50 | 5 | 4 | 3–4 |

TABLE 2-continued

| Dyeings of Nylon With Premetallized Solvent Dyes | | | | | | |
|---|---|---|---|---|---|---|
| C.I. Identity | | Solubility | Yield | AATCC Lightfastness Rating | | AATCC Washfastness Rating |
| Use Name | Constitution No. | % | % | 40 Hrs. | 200 Hrs. | |
| Solvent Blue 55 | 74400 | 1.5 | 45 | 3 | 1 | 4 |
| Solvent Black 35 | 12195 | 2 | 85 | 5 | 4 | 5 |
| Solvent Yellow 83:1 | | 3 | 100 | 5 | 4 | 4-5 |
| Solvent Orange 54 | | 2 | 90 | 5 | 4-5 | 4-5 |
| Solvent Red 22 | | 2.75 | 100 | 5 | 5 | 4-5 |
| Solvent Black 27 | | 2.5 | 100 | 5 | 5 | 5 |
| Solvent Black 45 | | 2.25 | 95 | 5 | 5 | 4 |

It will be seen from Table 1 that only two of the eleven nonionic solvent dyes gave passing results with both nylon and polyester, while three succeeded with nylon alone and six with polyester alone. The most distinctive differences between these nonionic solvent dyeings and the premetallized solvent dyeings lay in the inferior 200-hour lightfastness ratings shown in Table 1 for the nonionics, contrasted with the greatly superior behavior of the premetallized dyeings.

In Table 2 there are summarized the results of dyeing nylon with the eleven premetallized solvent dyes which satisfy the requirements of this invention, beginning with six of known chemical structure and ending with the dyes known only by their C.I. usage names.

A larger proportion of the premetallized solvent dyes than of the nonionic solvent dyes tested passed the standards for the dyes of the invention as set forth above. Even though they are effective only on nylon substrates, the premetallized solvent dyes are preferred to the nonionic solvent dyes and the reason for this is clearly shown in Table 2. The premetallized solvent dyes of the invention, with the sole exception of C.I. Solvent Blue 55, were greatly superior to the nonionic solvent dyes in the 200-hour lightfastness tests. Otherwise the performances of the dyeings with the two classes of dyes were not significantly different.

A total of 122 commercially available and standardized solvent dyes were tested, including 42 premetallized dyes and 65 nonionic dyes. The remainder of the 122 dyes were 10 basic dyes and 5 acid dyes, which 15 were not soluble enough in solvent to pass.

Out of the 42 premetallized solvent dyes tested, Table 2 shows six passing the tests whose formulas were found in The Colour Index. Besides these six dyes of known composition, five others identified only by their C.I. use names also passed: C.I. Solvent Yellow 83:1, C.I. Solvent Orange 54, C.I. Solvent Red 22, C.I. Solvent Black 27 and C.I. Solvent Black 45.

All of the lightfastness and washfastness data in Tables 1 and 2 were obtained from identical dyeings of 3×4-inch swatches of nylon 6,6 (14 ounce per square yard automotive fabric made from low tenacity staple) or of woven polyethylene terephthalate homopolymer fabric. The dyeings were carried out in one percent solutions of each dye in tris(2-ethyhexyl) trimellitate, preheated to 350° F. with the premetallized solvent dyes and 390° F. with the nonionic solvent dyes. (Dyeings of the more dyeable nylon at 350° F. with the premetallized dyes were as efficient as at 390° F., and were preferred because they afforded a larger margin of protection from thermal damage to the nylon fabric. Polyester needed the higher temperature for a high dyeing yield). Each swatch was immersed in the dyebath for one minute, then rinsed in perchlorethylene until the rinse liquor became free of color, after which the swatches were dried and portions were subjected to lightfastness and washfastness testing. The solubility and yield data in the Tables were determined as described above.

General dyeing conditions such as manner of application, operational temperatures and pressures, wet pickup, scouring, drying and other aspects of the process are in accordance with the conventional practice in the art, and need not be described in detail in this application.

What is claimed is:

1. In a process of dyeing synthetic textile fibers by exposing them at elevated temperatures to a waterless coloring composition composed of a high-boiling ester solvent and a dye, wherein the improvement comprises that the dye:

(1) is a nonionic solvent dye having a percent solubility, in the solvent at 350° F. in the range of about 2.0 to about 4.0%, based on the weight of the solvent, or a premetalized solvent dye having a percent solubility in the solvent at 350° F. in the range of about 1.5% to about 3.0%, based on the weight of the solvent;

(2) provides a depth of coloration, calculated as the quotient of the integrated depth value, of a sample dyed in the high-boiling ester solvent divided by the integrated depth value of a sample dyed in an aqueous dyeing system with the same weight of a proven disperse dye of the same or substantially the same color, expressed as % yield, of at least 25%;

(3) dyes the synthetic textile fibers to a lightfastness value, according to AATCC Test Method (16A-1982 for 40 hours of exposure, of at least 3; and (4) provides a washfastness value of at least 3 according to AATCC Test Method 61-1985-IA.

2. The process of claim 1, in which the percent solubility is determined in the solvent tris(2-ethylhexyl) trimellitate.

3. The process of claim 2, in which the dye is a solvent dye having a solubility in tris(2-ethylhexyl) trimellitate at 350° F. between about 1.5 and 3.0 percent.

4. The process of claim 2, in which the dye is a premetallized solvent dye having a solubility in tris(2-ethylhexyl) trimellitate at 350° F. between about 2 and about 4 percent.

5. The process of claim 1, in which the textile fibers are polyester.

6. The process of claim 1, in which the textile fibers are nylon.

7. The process of claim 1, in which the dye provides to the dyed synthetic textile fibers a lightfastness value of at least 3 after 200 hours.

8. A process of selecting a dye suitable for solvent dyeing textile fibers using high-boiling, non-ionic ester solvents, wherein the dye selected from among candidate pre-metalized solvent dyes and non-ionic solvent dyes:

(1) is soluble in the solvent at 350° F. to the extent of at least 1.5% by weight, based on the weight of the solvent;

(2) provides a depth of coloration, calculated as the quotient of the integrated depth value, of a sample dyed in the high-boiling ester solvent divided by the integrated depth value of a sample dyed in an aqueous dyeing system with the same weight of a proven disperse dye of the same or substantially the same color, expressed as % yield, of at least 25%;

(3) dyes the synthetic textile fibers to a lightfastness value according to AATCC Test Method 16A-1982 for 40 hours of exposure, or at least 3; and (4) provides a washfastness value of at least 3 according to AATCC Test Method 61-1985-IA.

* * * * *